US005355801A

United States Patent [19]

Donahue et al.

[11] Patent Number: 5,355,801

[45] Date of Patent: Oct. 18, 1994

[54] SMALL CALIBER FUZE WITH ARMING DELAY, SECOND IMPACT AND GRAZE SENSITIVITY

[76] Inventors: William J. Donahue, 1000 Lossing Ave., Colonial Beach, Va. 22443; Thomas A. Cammack, 4306 Birmingham Pl., Beltsville, Md. 20705; William C. Pickler, P.O. Box 0251, 12476 Lime Kiln Rd., Fulton, Md. 20759

[21] Appl. No.: 43,302

[22] Filed: Jun. 21, 1993

[51] Int. Cl.[5] ..... F42C 15/22; F42C 15/26

[52] U.S. Cl. ..... 102/233; 102/255; 102/267

[58] Field of Search ..... 102/265, 266, 267, 231, 102/232, 233, 244, 254, 255

[56] References Cited

U.S. PATENT DOCUMENTS

| | | | |
|---|---|---|---|
| 2,872,868 | 7/1955 | Donahue, Jr. et al. | 102/248 |
| 2,962,968 | 12/1960 | Neuwirth et al. | 102/267 |
| 3,177,810 | 4/1965 | Kipfer | 102/267 |
| 3,636,888 | 1/1972 | Aske | 102/266 |
| 4,004,521 | 1/1977 | Andrejkovics | 102/267 |
| 4,160,414 | 7/1979 | Stockman et al. | 102/254 |
| 4,213,395 | 7/1980 | Breed | 102/236 |
| 5,243,912 | 9/1993 | Ziemba | 102/235 |

*Primary Examiner*—David Brown

[57] ABSTRACT

The objectives of these inventions are to provide simple, reliable, and low-cost mechanical means to obtain (1) second impact detonation and (2) substantial safe arming separation from the gun for point detonating fuzes for small caliber spin stabilized shell. The first objective is attained by use of a heavy shield over the firing pin which is removable between the first and second impacts by spin forces; the second objective is attained by a centrifugally driven rotor, containing the out-of-line explosive element, which deforms a ductile material to effect the arming delay.

11 Claims, 6 Drawing Sheets

SMALL CALIBER FUZE WITH ARMING DELAY, SECOND IMPACT AND GRAZE SENSITIVITY

BACKGROUND OF THE INVENTION

1. Field of the Invention

The present invention generally relates to mechanical impact fuzing of rifle fired munitions and more specifically, to such fuzing of shells with diameters 40 mm and under as used in anti-aircraft defense, air-to-air, air-to-groiund, and ground-to-ground systems 2. Description of Prior Art A mechanical impact fuze has been developed for 20 mm fuzes which meets current safety and arming requirements for the U.S. military, but leaves considerable room for improvement. Current requirements include the detection of two independent firing signatures, traditionally set back and spin, before completely arming the fuze. Two other characteristics that have been desired, but not satisfactorily implemented are second impact detonation and an arming delay, not only to prevent premature firing in the barrel, but to protect friendly forces close to or in front of the weapon. Second impact detonation has meant the ability to poke through the skin of an aircraft and explode them inside on impact with a wing spar or other structural member.

The current fuzes for 20 mm ammunition use out-of-line detonators and fire on the first impact. An earlier model of this type of fuze had provisions for second impact detonation by virtue of adjusted detonator sensitivity to shock, but was found to be unreliable. To provide additional arming delay a number of techniques have been investigated. These include time escapement mechanisms, as first used in watches and clocks; slow burning pyrotechnic trains and fluid dashpots using gases and liquids. The dashpots have shown the most promise, but there are still problems with temperature, viscosity, aging and costs. Another desirable characteristic is the ability to detect and fire on a grazing impact.

SUMMARY OF THE INVENTION

According to the invention, the fuze uses an out-of-line booster section, wherein the arming is delayed by controlled torsion and/or shearing of a malleable delay member. A first light impact detonation is thwarted by an eccentric firing pin shield that spins off at impact. Additional actions are achieved by using a deformable firing pin assembly and spin sensitive structures that fire on graze impact. All of the above structures collapse on an impenetrable target for immediate detonation. The spin sensitive structures release the firing pin and firing spring to cause self destruction, when sufficient time has elapsed to permit the spin to decay.

An object of the present invention is, therefore, to provide a new small caliber fuze, which includes an improved safing and arming mechanism; wherein the chemical booster is rotated into line, instead of the detonator, for greater safety.

A further object of the present invention is, to provide a new small caliber fuze, which includes a cheap and reliable arming delay, to prevent damage likely to be caused by prematures.

A still further object of the present invention is, to provide a new small caliber fuze including second impact detonation that has a high probability of occurring within the aircraft skin.

Yet another object of the present invention is to provide a new small caliber fuze, which provides a graze detonation capability, to further increase its reliability.

A final object of the present invention is, to provide a new small caliber fuze which includes a novel self destruction capability, when the spin has decayed to a preselected value.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
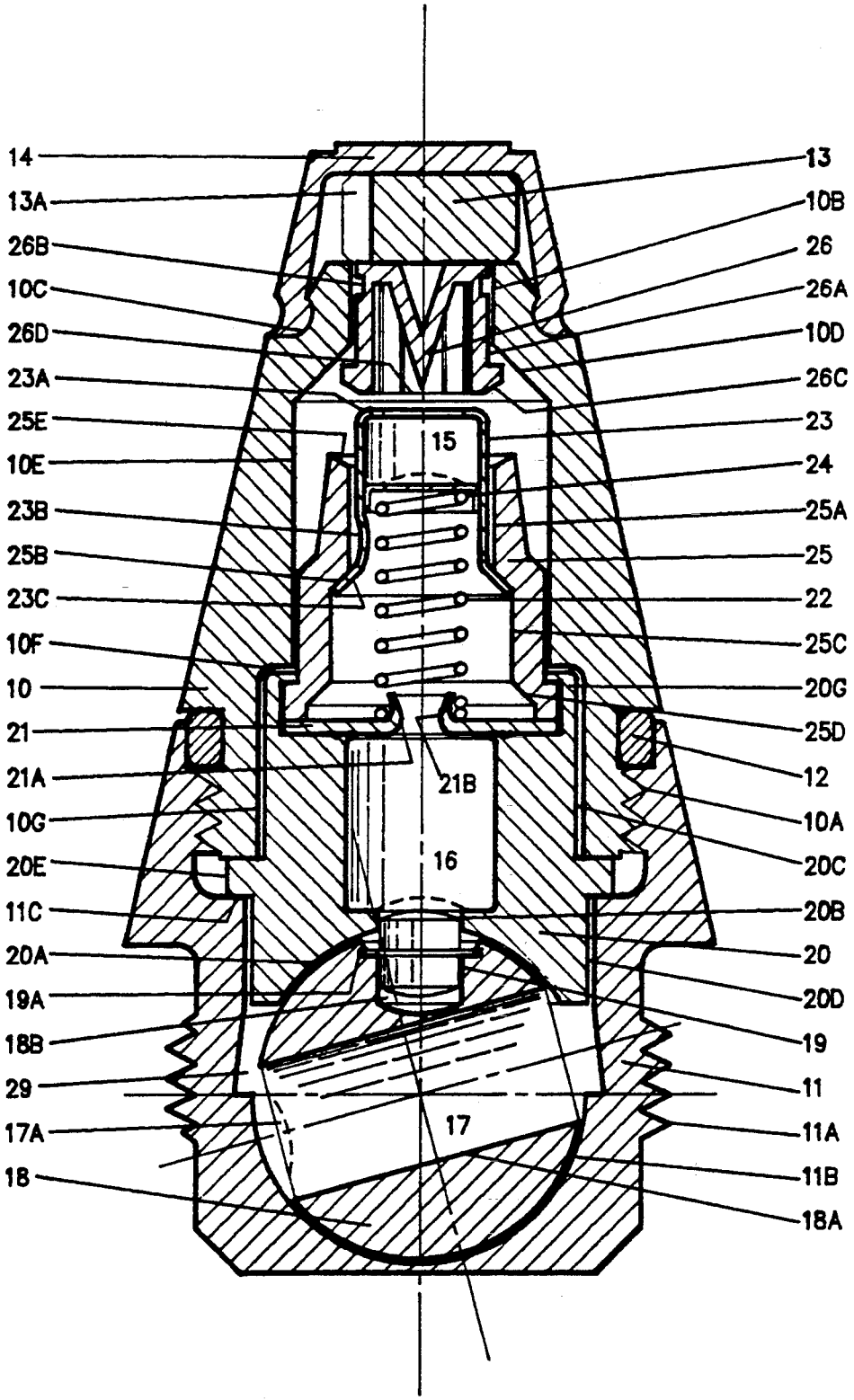
FIG. 1 is a view of the new fuze normally sectioned through its spin axis, with all interior components in their initial safe and unarmed positions.

Referring now to the drawings, and more particularly to FIG. 1, there is shown a side view in section of the fuze according to the present invention. The outer covering of the fuze consists mainly of a rigid hollow conical ogive 10 that tapers from a large diameter open rear end to a smaller diameter open front or nose end. The outer rear end has external threads 10A. These threads are covered by a cup shaped rotor cover 11 with internal threads that match and engage them. Just in front of the threads the surfaces of the ogive and rotor covers are relieved to capture an o-ring seal 12, which prevents moisture from seeping through this joint. The outside surface of the rotor cover has threads 11A that match those found in 20 mm or similar small calibre ammunition. The nose end of the ogive has an axial hole 10B surrounded by a circular groove 10C. The nose hole is substantially covered by a rigid eccentric firing pin shield 13, which is generally disk shaped, but has a notch 13A cut in the edge to provide spin imbalance. This shield is covered by a nose cover 14 of soft material e.g. aluminum or plastic, which is formed into a groove 10C around to keep it in place.

The inner surface of the ogive defines three cylindrical chambers decreasing in diameter from the large end. The nose hole 10B or front chamber is separated from the middle chamber 10E by a short tapered chamber 10D. The center chamber and rear chamber 10G are separated by a step 10F. Inside of and rearward of this ogive are the usual three elements of the chemical firing train, which ignite the main charge in an attached 20–40 mm shell. Beginning at the nose end, behind the point of a firing pin, these elements are, respectively, the primer 15, the detonator 16 and the booster 17. All are cylindrically shaped. They decrease in sensitivity and increase in total energy from the nose end.

A spherical arming rotor 18 carries the booster element 17. The latter occupies a cylindrical hole 18A drilled coaxially through the center of the rotor. The axis of the hole is normal to the rotation axis of the rotor and the hole opens out of opposed surfaces thereof. The ends of the booster have a concave cavity 17A or lens at each end to improve energy transfer along the train.

A blind hole 18B is also drilled coaxially toward the center of said rotor. The axis of the blind hole is normal to the axis of the rotor, but is about 15 degrees less than normal to the axis of the booster hole. The blind hole is slightly counterbored and a detent pin 19 with a thin integral shear flange 19A, the latter being staked into the counter bore. The detent pin has a length slightly less than that of the blind hole, but a substantial portion projects beyond the rotor surface. The inner surface of the rotor cover defines a rear concave hemispherical surface 11B. A similar front concave surface 20A is supplied by the rear end of a detonator support 20 to complete a spherical chamber closely surrounding the rotor. The front concave surface has an axial hole 20B drilled into it having a slightly larger diameter and length than the protruding portion of the detent pin. With the detent pin captured in this hole the rotor is rotated 15 degrees from its unstable equilibrium axis, so as to respond more reliably to spin.

The detonator support is a generally cylindrical member having a small diameter end 20C that slides snugly but freely into rear ogive chamber 10G. This support, which is usually die cast, also has a slightly larger diameter rear end 20D, which fits snugly but freely into the rotor cover 11 to provide the rear concave surface 20A above. Between these two ends is a little larger diameter circumferential flange 20E one side of which engages the large end of the ogive, when the support is fully inserted therein. The rear cover 11 has an internal corner 11C formed by a diameter change just behind its inside threaded portion. This corner engages the opposite side of the same flange, to secure the support as the ogive and rear cover are screwed together.

The detonator support has a cylindrical coaxial tunnel, that periodically varies in diameter along its length. The rear end or chamber of the tunnel is formed by the detent hole 20B above. The center chamber of the tunnel is dimensioned to be filled by the detonator 16. The counterbored blind hole is coaxial with and equal in diameter with the rear chamber of said tunnel. A front section has a length that is only a fraction of its diameter, the latter leaving only a thin support wall 20G at the front end. A washer 21 of substantially equal outside diameter is pressed into this chamber. The washer has a center hole 21A smaller in diameter than the detonator and a round boss 21B surrounding the center hole that projects to the front. The ends of the detonator are concave lenses like the booster to focus the explosive energy through the adjacent apertures in a manner well known in the art.

In front of the detonator support is the primer assembly. This includes a spring 22 with its rear end surrounding the washer boss. A primer cup 23, essentially a hollow tube with a narrow flat annular crimped front wall 23A, is fitted with the disk shaped primer 15. This primer 15 is held in place in the primer cup 23 by a retaining ring 24 crimped or bonded to the interior cup wall by epoxy or the like. The primer forms the rest of the front end of the cup, except for the crimped front wall 23A. This cup is placed over the spring, so that the front end of the spring presses against the rear face of the retaining ring. A support sleeve 25 is then placed over the primer cup. The sleeve has a small diameter front chamber 25A joined by a short reducing shoulder 25B to a large diameter rear chamber 25C. The rear chamber has a flare 25D at the open rear end that expands to the outside diameter of the washer. The rear edge of the cup's cylindrical sidewall terminates in a flare 23C that matches the inside of shoulder 25B between the front and rear portions of the sleeve, so that two engage to compress the spring slightly as the sleeve is pressed against the front surface of the washer. The thin wall 20G is crimped or staked over the flared end of the sleeve 25 to complete the assembly.

The cup flare 23C also matches the flare 25D at the rear end of the sleeve, in cross-section, so that the two will nest, when the cup is moved backward and off axis. An aperture 23B is formed in one side of the cup to induce a spin imbalance in this member.

Just ahead of the primer is the conical firing pin 26 with its point facing the primer. The pin, which is extruded from a metal like an alloy of aluminum, is surrounded by an integral castellated shroud. This shroud consists of n tines 26A extending from the base of the firing pin to a plane a short distance ahead of the point. The tines are equally spaced around the circumference of the base. Each tine has a thinned portion 26B at the base that acts as a hinge. The rear ends 26A of the tines have added mass for greater spin moment. The annular front surface 25E of the primer support sleeve is conically chamfered to slope to the rear and the center. The ends of the tines have radially outward areas 26C that are shaped to conform to this surface when the tines and primer support are pressed together. The tine ends also have radially inward areas 26D normal to the spin axis that conform to the crimped edge 23A of the primer cup. In this configuration the pin cannot contact the primer. Initially the pin is slipped into the small hole in the front of the ogive which is dimensioned to properly position and cover all but the massive ends of the tines.

Figure 2:
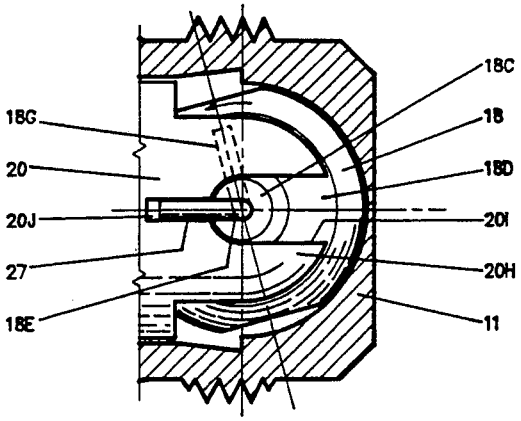
FIG. 2 is a view of the right or rear end of FIG. 1 showing the complete rotor, one trunnion, a trunnion support and a torsion wire delay member.

Referring to FIG. 2 a rearward extending journal ear 20H of the detonator support is shown. A similar ear is defined by the support on the opposite side of the rotor. These ears have journal slots 20I, opening through the rear edge to permit insertion of the rotor. Opposed annular surfaces 18D of the rotor normal to its axis of rotation are flattened to provide space for the ears, which have mating flat surfaces. The center of the annular surface, which is not changed, defines a trunnion 18C with a diameter slightly less than the width of the journal slot. The trunnion has an axial hole 18E drilled through to freely admit a torsion delay wire 27. The ears have a wire groove 20J extending from the hole toward the root of the ear, into which the outer end of the delay wire is bent. The opposite or inner end of the delay wire extends into the hole for the booster and is bent into an axially parallel wire groove 18G in the booster hole wall, before the booster is inserted. The bent portions initially have a 75 degree angular relationship, but become parallel, when the rotor moves to its armed position. When the fuze spins the rotor is urged to rotate on its trunnions, to align the axis of the booster with the spin axis, which strongly urges the rotor into its armed position. The delay wire is made of a malleable material such as alloys of soft non-ferrous metals, elastomers or other plastics. These wires, which can be used on one or both trunnions, do not provide enough resistance to prevent arming, but can provide adequate safety delays. The delay time depends on the material or alloy used and the diameter of the wire, which of course should not be so close to the diameter of the trunnion as to weaken it. Tests of 50/50 lead-tin solder have indicated that such a delay wire could have a diameter of about 1 mm to produce a 300 foot arming delay with an accuracy of ±15 feet.

Figure 3:
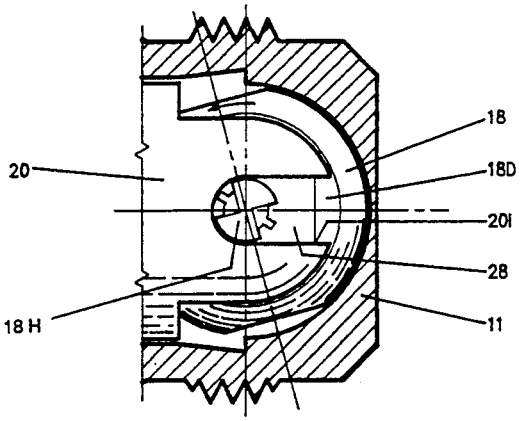
FIG. 3 is a similar view with the fuze rotated 180° about its axis showing the other complete end of the rotor, the remaining trunnion, another trunnion support and a shear plate delay member.

FIG. 3 shows a different embodiment of a cutter trunnion 18H opposite the one described above. This trunnion is axially grooved, so it provides one or more cutting edges that move in the direction of rotation as the rotor arms. The inner surface of the ear is relieved enough to admit a thin plate 28 of malleable material between the flat surface of the rotor and its journal support ear which provides an opening for the trunnion, but which is also shaped to periodically obstruct its rotation. The cutting surfaces permit the rotor to remove the obstructions, but only after a specified time delay. Various time delays can be provided by using different materials, different thicknesses of the plate, and by varying the geometry of the obstructions.

Figure 4:
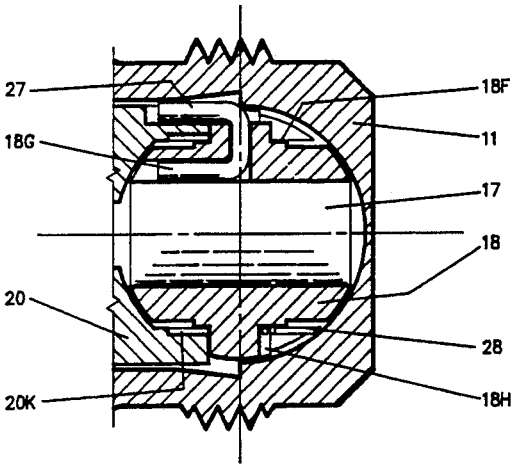
FIG. 4 is a similar view looking into the top of FIG. 3. or the bottom of FIG. 2 with the rotor turned to its armed position and a full view of the torsion wire delay member.

As shown in FIG. 4, the front edge of the plate contacts a relief step 20K in the detonator support to prevent its rotation during the arming function. This type of delay can also be applied to both trunnions. This figure also shows a view of the rotor and adjacent structures rotated 90 degrees about the spin axis of the fuze from that of FIG. 2 or FIG. 3. The torsion delay wire is shown in full view and the delay shear plate as a cutaway edge view. Also shown is a small step 18F in the annular flat surfaces of the rotor around the base of the trunnions, This step reduces friction between the rotor and the adjoining surfaces.

Figure 5:
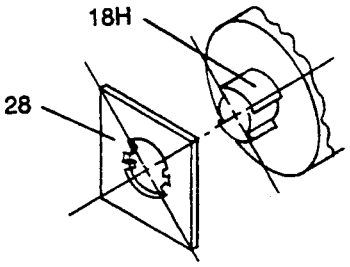
FIG. 5 is an exploded isometric view of the shear plate and its trunnion on one end of the rotor.

FIG. 5 shows an isometric view of the cutter trunnion and its delay plate, exploded for added clarity. The toothed geometry permits smoother cutting digitized delays. Note that opposed cutters are provided which allows the use of dead soft materials for the delay plate. This insures sufficient resistance to arming without resorting to a critical tempering process. But more importantly it should be noted that the rotor structure is intentionally designed with a symmetry that requires no special orientation during assembly. As can be seen neither the delay plate structure nor the torsion wire shown has inherent left or right handedness.

Figure 6:
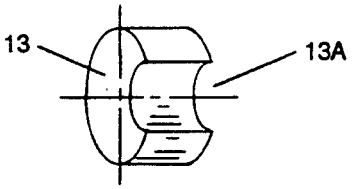
FIG. 6 is an isometric view of the eccentric firing pin shield for the nose of the fuze.

FIG. 6 shows the firing pin shield or slug in isometric view. These are easily stamped by a circular punch using overlapping cuts. This also saves material. The shield may made of steel which is also the presently preferred material for the ogive and rotor housing. The primer cup 23 can be drawn from aluminum. The sleeve, detonator support and the rotor may be die cast from zinc or aluminum, preferably zinc for the rotor. The washer can be punched from a variety of materials. The detent pin is turned on automatic screw machines. The nose cover is extruded from soft aluminum and best attached by roll crimping over a layer of liquid latex.

Figure 7:
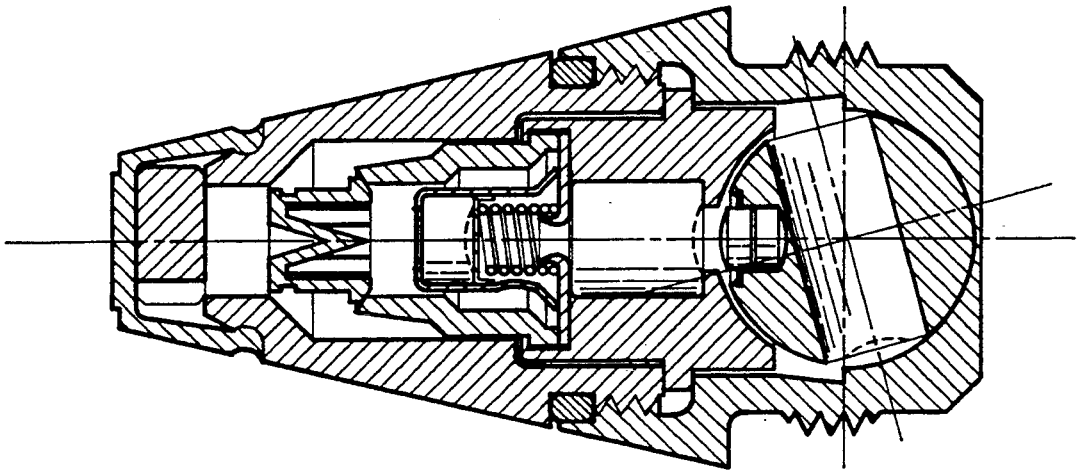
FIG. 7 is a view as in FIG. 1 showing the position of internal members after sensing set back.

FIG. 7 shows the same view as FIG. 1 after the fuze reacts to firing setback of the shell. Note that the shear flange on the detent pin has failed allowing that pin to move back and the primer cup has moved back against the washer on the front of the detonator support greatly compressing the firing spring. The rotor has not turned, because the slotted journal structure permits maximum rotor contact with the rotor housing during set back. This additional friction is sufficient to overcome the torque induced by spin. The shroud on the firing pin has moved back against the chamfered end of the sleeve on the primer assembly and pushed back the primer cup, but the pin's point cannot reach the primer. The preferred pin has six tines, which provides a convenient geometry that gives good function and is simple to manufacture. The chamfer of the nearest edge of the primer sleeve and the mating chamfer of the tines causes a locking action between the two that resists separation by the onset of spin. This relationship holds until set back decays and a short time thereafter as the spin forces overcome the friction between the inclined surfaces. If no spin is encountered the primer moves forward pressing against the tines of the firing pin to return it to its recess.

Figure 8:
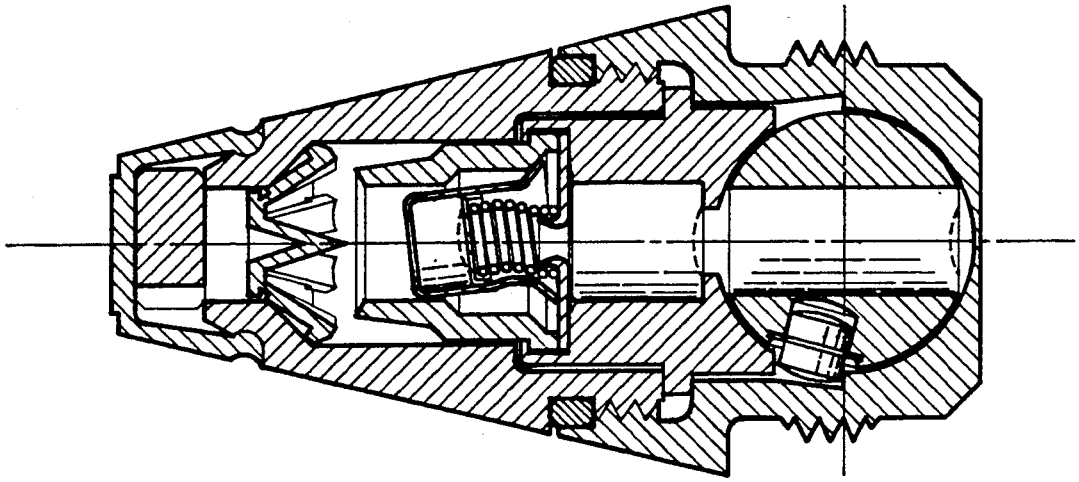
FIG. 8 is a view as in FIG. 1 showing the position of internal members after sensing both set back and spin.

FIG. 8 shows the same view of the fuze after spin is fully induced and the effects of setback have disappeared. After the fuze has flown about one tenth of a second or 300 feet the rotor has moved to its armed position with the axis of the booster coaxial with the spin axis. The detent once off the spin axis picks up centrifugal force that eventually overcomes the decaying set back force. As the rotor turns it begins to slide over the concave face of the detonator support until it drops off the edge and locks in a space 29 between this edge and a shoulder formed at the edge of the hemispherical inner face in the rotor housing. The tines of the firing pin have dislodged themselves from the detonator support pushing the pin gently forward into the nose hole. The tines, however, have spread to the walls of the center ogive chamber the conical wall in front guiding the pin into its exposed position. The primer cup is displaced due to the hole in one side and has lodged itself under the inner shoulder between the flared rear end of the primer sleeve and the washer in front of the detonator.

Figure 9:
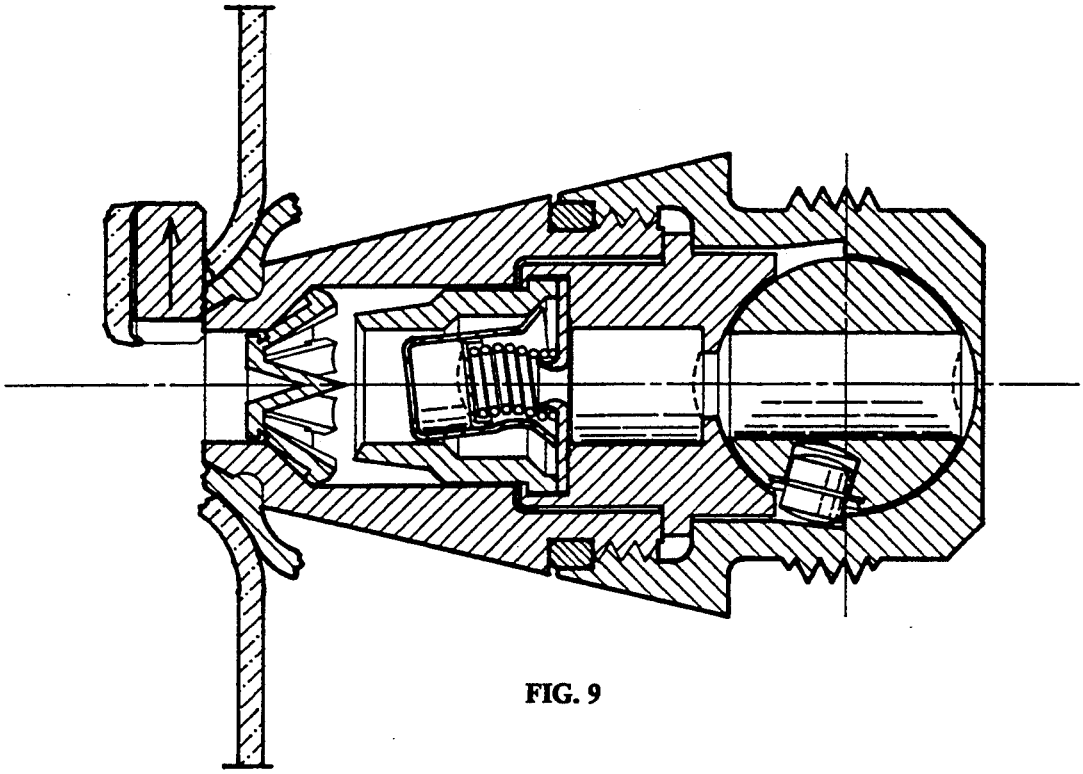
FIG. 9 is a view as in FIG. 1 showing the position of internal members after the fuze experiences a first impact with a light target.

FIG. 9 shows the same view after the fuze has made a light impact as with an aircraft's skin. The main effect is on the nose cap which is sheared by the harder skin material. This frees the eccentric nose shield which is driven off axis by spin induced force. Since little spin is lost the primer cup remains lodged under the flared end of the primer sleeve and the tines of the firing pin resist the slight tendency to move into the nose.

Figure 10:
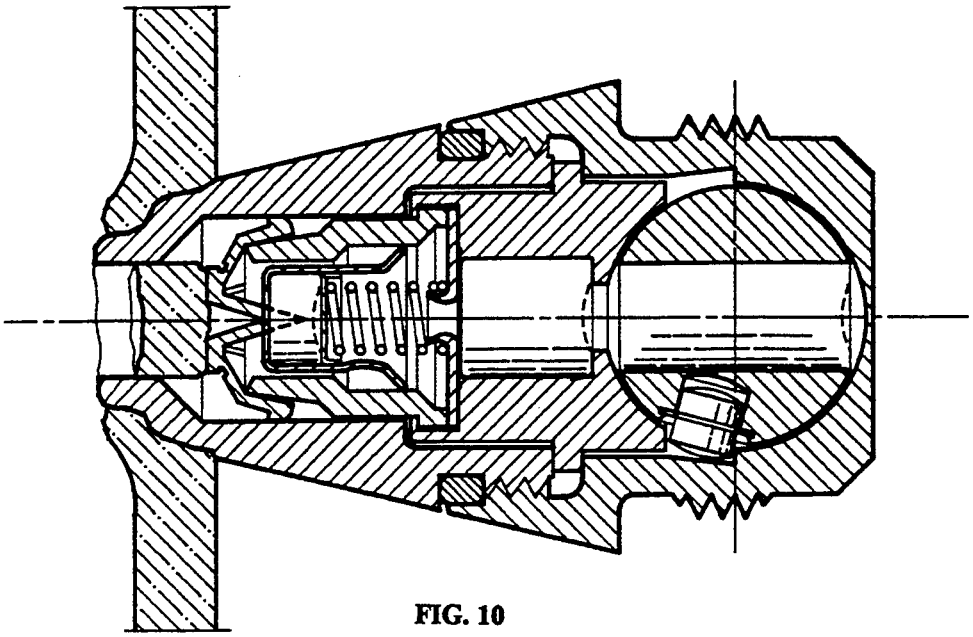
FIG. 10 is a view as in FIG. 1 showing the position of internal members after the fuze experiences a second impact with a light to medium target.

FIG. 10 shows the same view after a second impact with a light to medium target. Such targets are soft and thin enough to have a piece coined out of them by the relatively sharp front edge of the ogive. The coined fragment should have sufficient momentum to drive the firing pin into the primer crumbling the shroud. If spin is sufficiently reduced due to the first and second impact the primer cup may also dislodge and permit the firing spring to extend.

Figure 11:
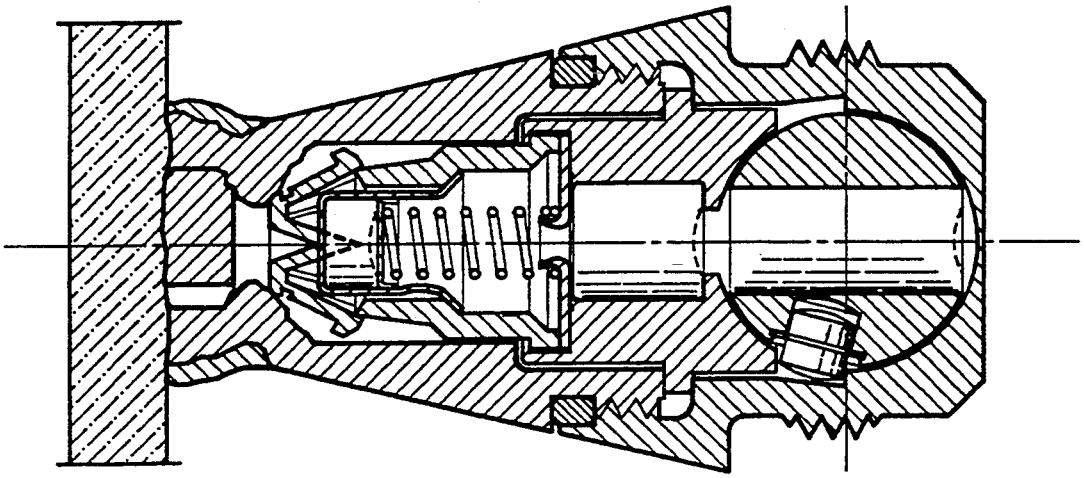
FIG. 11 is a view as in FIG. 1 showing the position of internal members after the fuze experiences impact with a heavy or an impenetrable target.

FIG. 11 shows the same view after a first impact with an impenetrable target. In this situation the firing pin shield is driven into the nose hole collapsing the front of the ogive and the firing pin into the primer. Since spin is lost at the same time the cup escapes the flared end of the primer sleeve allowing the firing spring to expand.

Figure 12:
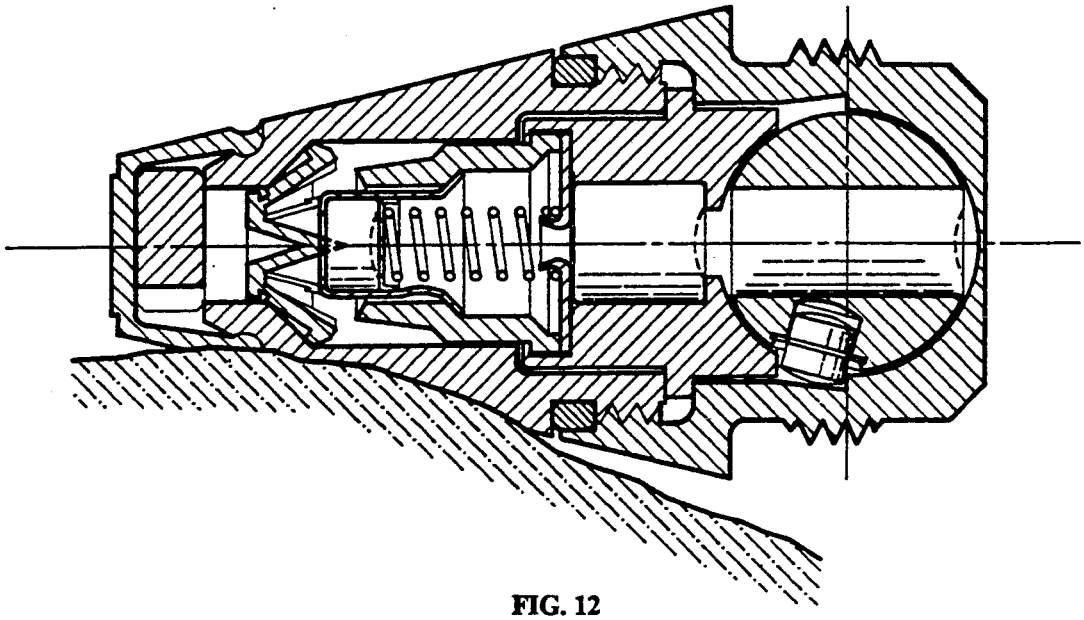
FIG. 12 is a view as in FIG. 1 showing the position of internal members after the fuze experiences a graze impact with a target.
Figure 13:
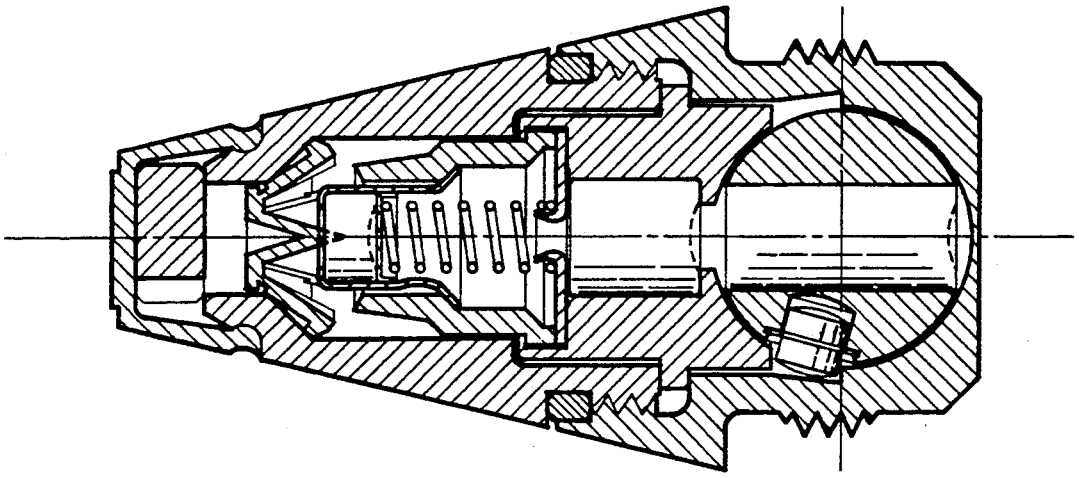
FIG. 13 is a view as in FIG. 1 showing the position of internal members after the fuze experiences sufficient spin decay to initiate self destruction.

FIG. 12 shows the same view after a first grazing impact. The nature of this impact involves both a large loss in spin as well a fair amount of deceleration. Both of these factors operate to free the cup from the sleeve and the spring drives the primer onto the firing pin. The same fuze configuration applies to the self destruction situation (FIG. 13). Once there is enough spin decay the cup is freed by the pressure of the firing spring which then drives the primer onto the firing pin.

While this invention has been described in terms of preferred embodiment consisting of a 20 mm fuze, those skilled in the art will recognize that the invention can be practiced with modification within the spirit and scope of the appended claims.

Having thus described my invention, what I claim as new and desire to secure by Letters Patent is as follows:

1. A fuze for an explosive shell having diameter of 40 mm or less, which comprises:

a body that tapers from a large diameter rear end, with an external portion threaded to mate with said shell, to a small diameter at the front or nose end;

a conical firing pin mounted in said nose end pointing to the rear of the body;

a detonator housing mounted centrally in said body defining a tunnel from the front to the rear of said body with front, rear and center chambers, said center chamber being filled with detonator material to form a detonator;

a primer assembly mounted on the front end of said detonator housing, supporting a primer cup with a cylindrical sidewall and a circular endwall, the rear surface of said endwall being covered with a primer disk and the front surface thereof being adjacent to said pin;

an out-of-line spin actuated arming rotor loaded with booster material mounted on the rear end of said detonator housing;

said rotor including a mechanical means to allow said booster to come in line with the said primer disk and detonator only after setback, spin and a minimum safety delay of one tenth of a second has occurred in that order.

2. A fuze according to claim 1 wherein said mechanical means includes:

a short rod of malleable material aligned with the axis of said rotor affixed at one end to said rotor and at its opposite end to said detonator support, whereby the twisting of said rod by said rotor produces said safety delay.

3. A fuze according to claim 1 wherein said mechanical means includes:

a key shaped trunnion on said rotor;

a thin plate of malleable material fixed at its edges to said detonator support and keyed at its center to said rotor, whereby the tearing of said plate by said key shaped trunnion produces said safety delay.

4. A fuze as set forth in claim 1, wherein said fuze includes;

an overlapping rear cup-shaped rotor housing with mating threads;

said detonator housing having a centrally defined external circumferential flange locked between inner edges of said tapered body and said housing when threaded together; and an O-ring locked between outer edges of said tapered body and said housing.

5. A fuze as set forth in claim 4, wherein said rotor is generally spherical and said mechanical means includes two aligned trunnions on opposite sides thereof and a cylindrical booster chamber with an axis through the center of said rotor normal to the axis of said trunnions;

the rear surface of said detonator housing and the inner front surface of said rotor housing each defining one-half of a generally spherical rotor chamber concentric with and slightly larger than said rotor and centered on the axis of said tunnel;

said detonator housing further defining two radially thin and rearwardly projecting rotor supports adjacent opposite sides of said rotor chamber defining journals for said trunnions;

said rotor further defining a cylindrical slightly counterbored blind hole equal in diameter and coaxial with said rear chamber of said tunnel with its axis at 75° with the axis of said booster chamber;

a cylindrical locking detent slightly less in length and diameter to said blind hole, said detent extending into both said hole and said rear chamber, with an integral thin shear flange staked into said counterbore.

6. A fuze according to claim 1 wherein the nose end of said body defines an axial nose hole having substantially the same length and diameter as said pin, said hole opening into a body chamber of much larger diameter, said pin being housed in said hole and further including:

an integral castellated shroud of n tines that project rearward from the circular base of said pin to a normal plane slightly beyond the apex of said pin, said tines each having a narrow flexible hinge portion adjacent said pin base and a massive distal end initially oriented and shaped to engage 1/n of the annular front end surface of said primer assembly, to prevent said pin from prematurely penetrating said primer cup.

7. A fuze as set forth in claim 6, wherein:

said body defines an axial hole through said nose end, with a groove surrounding the external opening to said hole and said pin located in said hole;

said external opening of said nose hole being covered by a disk shaped steel slug axially aligned with said hole but having an off center portion removed to produce spin instability; and a soft metal cover over said slug pressed into a groove around said hole defined by the exterior surface of said ogive.

8. A fuze as set forth in claim 6, wherein:

said distal ends and the front edge of said primer assembly are conically chamfered to force said tines radially inward on set-back and to delay spin separation of said tines until shortly after set-back ends.

9. A fuze as set forth in claim 1, wherein said primer assembly further includes:

a flared rear edge on said cup sidewall, said sidewall having a substantial opening on one side to produce spin instability for radial displacement;

an axial primer support sleeve surrounding said cup, the inside of said sleeve having a front diameter greater than the diameter of said circular endwall but less than the diameter of said flared end, a center diameter slightly larger than said flared cup end and a flared sleeve end shaped to nest said flared cup end when said cup is radially displaced by spin;

a washer equal in diameter to the flared end of said sleeve contacting and covering said flared end;

an axial firing spring within said sleeve compressed between said washer and said primer disk causing, the flared edge of said primer cup to engage the shoulder at the diameter change in said sleeve.

10. A fuze according to claim 9, wherein:

the edge of the washer around its center hole is raised to engage the inner edge of said spring to center it.

11. A fuze according to claim 9, wherein:

said flared sleeve end and said washer are pressed into a front cylindrical chamber of said detonator support with the front edge of chamber crimped over said sleeve.

* * * * *